US010056181B2

(12) United States Patent
Yosui

(10) Patent No.: US 10,056,181 B2
(45) Date of Patent: Aug. 21, 2018

(54) STACKED COIL ELEMENT AND METHOD FOR MANUFACTURING THE SAME

(71) Applicant: Murata Manufacturing Co., Ltd., Nagaokakyo-shi, Kyoto-fu (JP)

(72) Inventor: Kuniaki Yosui, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 43 days.

(21) Appl. No.: 15/177,381

(22) Filed: Jun. 9, 2016

(65) Prior Publication Data

US 2016/0293322 A1 Oct. 6, 2016

Related U.S. Application Data

(63) Continuation of application No. PCT/JP2015/056483, filed on Mar. 5, 2015.

(30) Foreign Application Priority Data

Mar. 14, 2014 (JP) ..... 2014-052044

(51) Int. Cl.
*H01F 5/00* (2006.01)
*H01F 27/28* (2006.01)
(Continued)

(52) U.S. Cl.
CPC ..... *H01F 27/2804* (2013.01); *H01F 5/00* (2013.01); *H01F 17/0013* (2013.01);
(Continued)

(58) Field of Classification Search
CPC ..... H01F 5/00; H01F 27/00–27/36
(Continued)

(56) References Cited

U.S. PATENT DOCUMENTS 3,848,210 A * 11/1974 Felkner ..... H01F 17/04 336/200
4,985,374 A * 1/1991 Tsuji ..... G03F 7/2022 148/DIG. 137
(Continued)

FOREIGN PATENT DOCUMENTS

JP 7-263231 A 10/1995
JP 2006-41320 A 2/2006
(Continued)

OTHER PUBLICATIONS

Official Communication issued in International Application PCT/JP2015/056483, dated May 19, 2015.

*Primary Examiner* — Tuyen Nguyen
(74) *Attorney, Agent, or Firm* — Keating & Bennett, LLP

(57) ABSTRACT

A stacked coil element includes a stack including a plurality of insulating layers and a coil conductor structure with a winding axis in a thickness direction, and conductor patterns defining a portion of a coil provided on the insulating layers and electrically connected in the thickness direction. The stack includes a coil inner hole on an inner peripheral side of the coil conductor structure, the coil inner hole penetrating in the direction of the winding axis or having the direction of the winding axis as a depth direction. In at least one of the plurality of insulating layers, an end surface of the conductor pattern on the coil inner hole side is in the same plane as an end surface of the insulating layer on the coil inner hole side.

12 Claims, 15 Drawing Sheets

(51) Int. Cl.

| | |
|---|---|
| ***H01F 17/00*** | (2006.01) |
| ***H01F 41/04*** | (2006.01) |
| ***H01F 27/24*** | (2006.01) |
| ***H01F 41/02*** | (2006.01) |

(52) U.S. Cl.
CPC ..... *H01F 17/0033* (2013.01); *H01F 27/24* (2013.01); *H01F 41/0206* (2013.01); *H01F 41/041* (2013.01); *H01F 41/042* (2013.01); *H01F 41/046* (2013.01); *H01F 2027/2809* (2013.01)

(58) Field of Classification Search
USPC ..... 336/65, 83, 200, 206–208, 232
See application file for complete search history.

(56) References Cited

U.S. PATENT DOCUMENTS

| | | | | |
|---|---|---|---|---|
| 2009/0160018 | A1 | 6/2009 | Nabeshima et al. | |
| 2010/0244186 | A1* | 9/2010 | Katsumata ..... | H01L 27/0207<br>257/530 |
| 2011/0177666 | A1* | 7/2011 | Nozawa ..... | H01L 27/101<br>438/382 |

FOREIGN PATENT DOCUMENTS

| | | | |
|---|---|---|---|
| JP | 2007-281025 | A | 10/2007 |
| JP | 2009-152406 | A | 7/2009 |
| JP | 2011-165807 | A | 8/2011 |

* cited by examiner

STACKED COIL ELEMENT AND METHOD FOR MANUFACTURING THE SAME

CROSS REFERENCE TO RELATED APPLICATIONS

This application claims the benefit of priority to Japanese Patent Application 2014-052044 filed Mar. 14, 2014 and is a Continuation Application of PCT/JP2015/056483 filed on Mar. 5, 2015. The entire contents of each application are hereby incorporated by reference.

BACKGROUND OF THE INVENTION

1. Field of the Invention

The present invention relates to a stacked coil element and a method for manufacturing the same.

2. Description of the Related Art

A stacked coil element can be obtained, for example, by stacking and integrating insulator sheets having, on main surfaces thereof, conductor patterns shaped to form a portion of a coil.

The insulator sheet having, on the main surface thereof, the conductor pattern shaped to form a portion of the coil can be obtained, for example, by etching a conductive foil of an insulator sheet having the conductive foil affixed to an entire main surface thereof. Alternatively, instead of using the insulator sheet having the conductive foil affixed preliminarily to the entire surface thereof, the insulator sheet can be obtained by screen printing a conductive paste onto a main surface of an insulator sheet to which a conductive foil is not affixed.

Japanese Patent Laying-Open No. 2007-281025 describes a configuration of a stacked chip coil in which a through hole penetrating through a first magnetic material portion is formed and a second magnetic material portion is arranged in this through hole in order to achieve a high inductance value as well as an excellent DC superimposition property and a low resistance.

It has been known that in a stacked coil element, a conductor pattern forming a portion of a coil is obtained by etching or screen printing. In either case, however, an end of the obtained conductor pattern has a surface that is not perpendicular to, but inclined with respect to a main surface, and a base portion of the inclined surface is thin for use as the conductor pattern. In the case where the end of the conductor pattern has such a thin portion on the inner peripheral side of the coil, an electric current concentrates on this thin portion of the end on the inner peripheral side when the electric current is actually passed through the stacked coil element, which causes electrical energy loss.

SUMMARY OF THE INVENTION

Preferred embodiments of the present invention provide a stacked coil element and a method for manufacturing the same, which make it possible to reduce the electrical energy loss caused by concentration of an electric current on a thin portion of an end on the inner peripheral side of a coil during the passage of the electric current.

A stacked coil element according to a preferred embodiment of the present invention includes a stack of a plurality of insulating layers including a coil conductor structure with a winding axis in a thickness direction, and conductor patterns defining a portion of a coil provided on the insulating layers and electrically connected in the thickness direction. The stack includes a coil inner hole on an inner peripheral side of the coil conductor structure, the coil inner hole penetrating in the direction of the winding axis or having the direction of the winding axis as a depth direction. In at least one of the plurality of insulating layers, a coil-inner-hole-side end surface of the conductor pattern is in the same plane as a coil-inner-hole-side end surface of the insulating layer.

According to a preferred embodiment of the present invention, in at least a portion of the insulating layers included in the stack, the thin portion is not provided at the end of conductor pattern on the coil inner hole side. Therefore, the electrical energy loss caused by concentration of the electric current on the thin portion of the end on the inner peripheral side of the coil during the passage of the electric current is reduced.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

Figure 1:
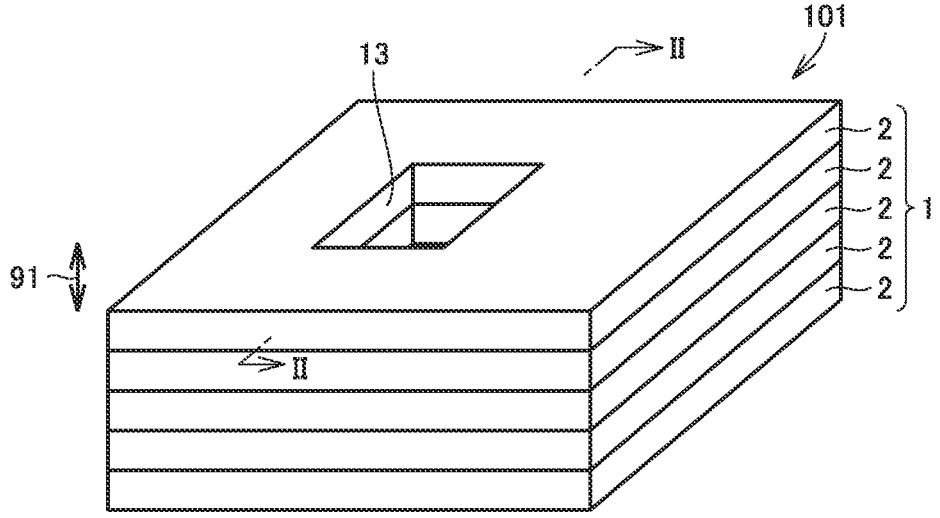
FIG. 1 is a perspective view of a stacked coil element according to a first preferred embodiment of the present invention.
Figure 2:
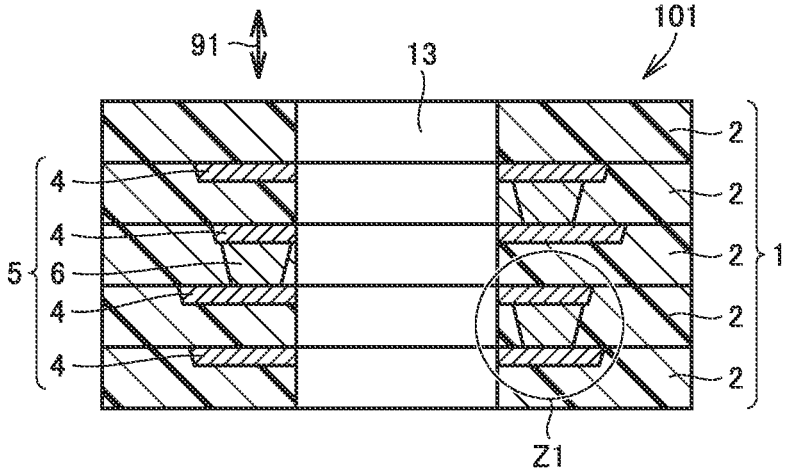
FIG. 2 is a cross-sectional view taken along line II-II in FIG. 1.
Figure 3:
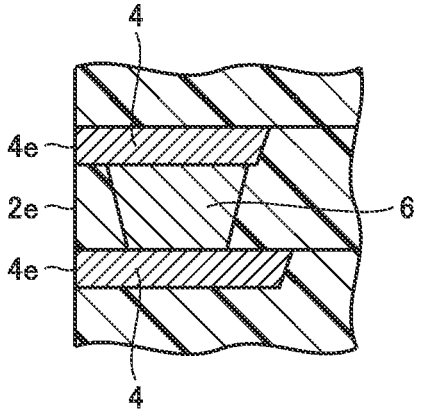
FIG. 3 is an enlarged view of a Z1 portion in FIG. 2.

A stacked coil element according to a first preferred embodiment of the present invention will be described with reference to FIGS. 1 to 3. A perspective view of the whole of a stacked coil element 101 according to the present preferred embodiment is shown in FIG. 1. A cross-sectional view taken along line II-II in FIG. 1 is shown in FIG. 2. An enlarged view of a Z1 portion in FIG. 2 is shown in FIG. 3.

Stacked coil element 101 according to the present preferred embodiment includes a stack 1 including a plurality of insulating layers 2 and a coil conductor structure 5 with a winding axis in a thickness direction 91, and conductor patterns 4 defining a portion of a coil and electrically connected in the thickness direction. Stack 1 includes a coil inner hole 13 on an inner peripheral side of coil conductor structure 5, and coil inner hole 13 penetrates in the direction of the winding axis or has the direction of the winding axis as a depth direction. As shown in FIG. 3, in at least one of the plurality of insulating layers 2, an end surface 4*e* of conductor pattern 4 on the coil inner hole 13 side is in the same plane as an end surface 2*e* of insulating layer 2 on the coil inner hole 13 side.

Electrical connection between conductor patterns 4 in the thickness direction is provided by a conductive via 6 that defines and functions as an interlayer connecting conductor. Although coil inner hole 13 is a hole completely penetrating through stack 1 in the thickness direction in the example described according to the present preferred embodiment, a hole that does not penetrate but has a bottom may be provided, instead of a through hole like coil inner hole 13.

According to the present preferred embodiment, in at least one of the plurality of insulating layers 2, end surface 4*e* of conductor pattern 4 on the coil inner hole 13 side is in the same plane as end surface 2*e* of insulating layer 2 on the coil inner hole 13 side, and thus, end surface 4*e* is being parallel or substantially parallel to thickness direction 91. In other words, end surface 4*e* is a surface perpendicular to the main surface of insulating layer 2. In such a configuration, in at least a portion of insulating layers 2 included in stack 1, a thin portion is not provided at an end of conductor pattern 4 on the coil inner hole 13 side. Therefore, the electrical energy loss caused by concentration of an electric current on the thin portion of the end on the inner peripheral side of the coil during the passage of the electric current is reduced.

While a non-limiting example of a method for manufacturing stacked coil element 101 will be described in detail below, coil inner hole 13 may be formed by boring a through hole in separate individual insulating layer 2 at a stage prior to stacking, or may be formed at a time after the plurality of insulating layers 2 are stacked to form stack 1.

According to the present preferred embodiment, in two or more insulating layers 2 adjacent in the thickness direction, of the plurality of insulating layers 2, all of end surfaces 4*e*, on the coil inner hole 13 side, of conductor patterns 4 provided on the two or more insulating layers 2 and end surfaces 2*e* of the two or more insulating layers 2 on the coil inner hole 13 side are preferably in the same plane. This does not require that the condition should be satisfied for all insulating layers 2 included in stack 1, and when attention is focused on any two or more of insulating layers 2 which are a portion of all insulating layers 2 included in stack 1, the condition may only be satisfied in these insulating layers 2. The example shown in FIG. 2 has a configuration that satisfies this condition. By adopting this configuration, the positions on the inner peripheral side of coil conductor structure 5 are aligned within the range of the two or more insulating layers 2, and thus, higher accuracy of the coil is achieved.

Furthermore, in all of the plurality of insulating layers 2, all of end surfaces 4*e* of conductor patterns 4 on the coil inner hole 13 side and end surfaces 2*e* of insulating layers on the coil inner hole 13 side are preferably in the same plane. The example shown in FIG. 2 has a configuration that satisfies this condition. By adopting this configuration, the positions on the inner peripheral side of coil conductor structure 5 are all aligned, and thus, a higher degree of reproducibility of the coil properties is achieved. In addition, with this configuration, fabrication by boring coil inner hole 13 at a time after forming stack 1 becomes easy.

In the example of stacked coil element 101 shown in FIG. 1, stacked coil element 101 preferably has a rectangular or substantially rectangular parallelepiped external shape in which a length in the horizontal direction in the figure is slightly longer than a length in the depth direction in the figure. However, this is merely one example and the stacked coil element may have other shapes. In addition, coil inner hole 13 preferably has a square or substantially square shape at a position slightly displaced toward one side from the center of stacked coil element 101. However, this is merely one example and the shape and position of the coil inner hole is not limited to those shown in FIG. 1.

Second Preferred Embodiment

Figure 4:
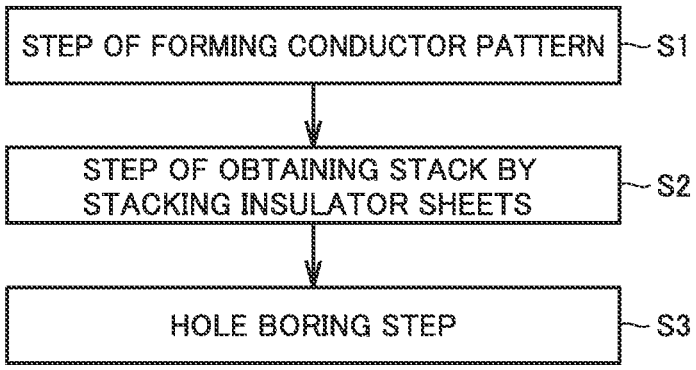
FIG. 4 is a flowchart of a method for manufacturing a stacked coil element according to a second preferred embodiment of the present invention.

A method for manufacturing a stacked coil element according to a second preferred embodiment of the present invention will be described with reference to FIGS. 4 to 14. The method for manufacturing the stacked coil element according to the present preferred embodiment is a method for obtaining the stacked coil element described in the first preferred embodiment. A flowchart of the method for manufacturing the stacked coil element according to the present preferred embodiment is shown in FIG. 4.

The method for manufacturing the stacked coil element according to the present preferred embodiment is a method for manufacturing a stacked coil element including a coil conductor structure including a stack of a plurality of insulating layers and a winding axis extending in a thickness direction, and conductor patterns defining a portion of a coil and electrically connecting to each other, the method including a step S1 of forming, on each of the plurality of insulating layers, the conductor pattern defining a portion of the coil; a step S2 of obtaining a stack by stacking the insulating layers having the conductor patterns formed thereon; and a hole boring step S3 of, in at least one of the plurality of insulating layers, boring a hole in a portion corresponding to an inner side of the coil conductor structure, such that a portion of the conductor pattern is removed, and a hole-side end surface of the insulating layer and a hole-side end surface of the conductor pattern are in the same plane.

The steps will be described in detail below.

Figure 5:
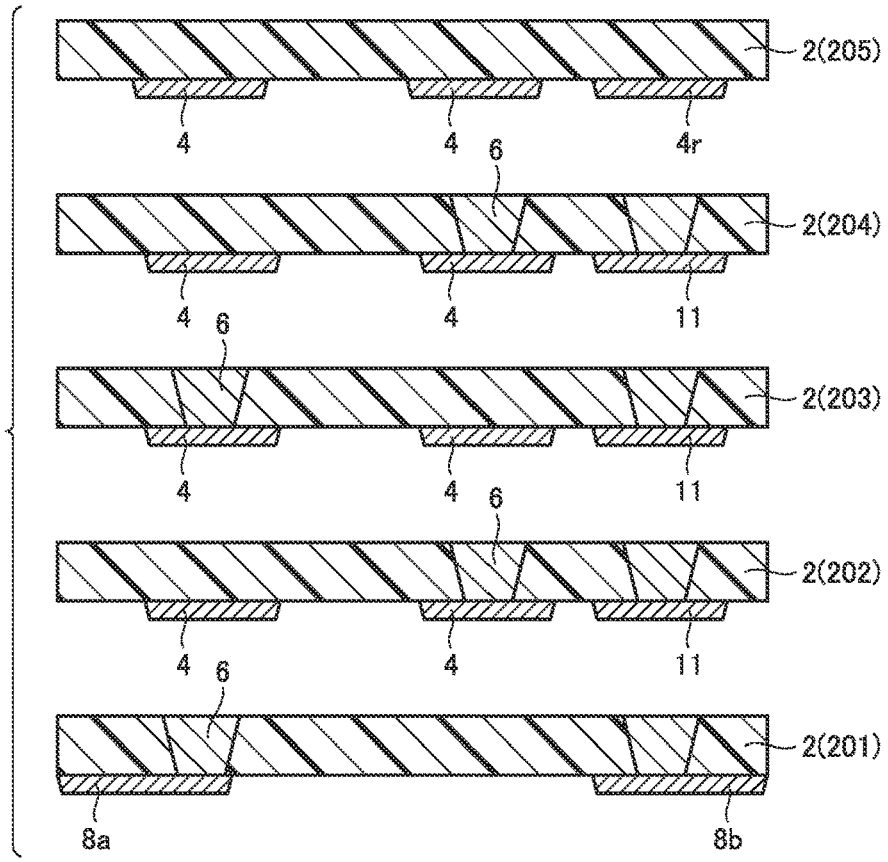
FIG. 5 is an explanatory view of a first step of the method for manufacturing the stacked coil element according to the second preferred embodiment of the present invention.
Figure 6:
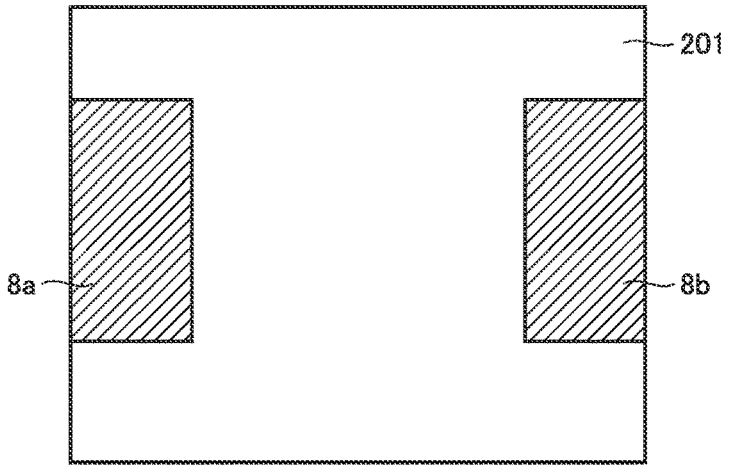
FIG. 6 is a bottom view of a first insulating layer used in the method for manufacturing the stacked coil element according to the second preferred embodiment of the present invention.
Figure 7:
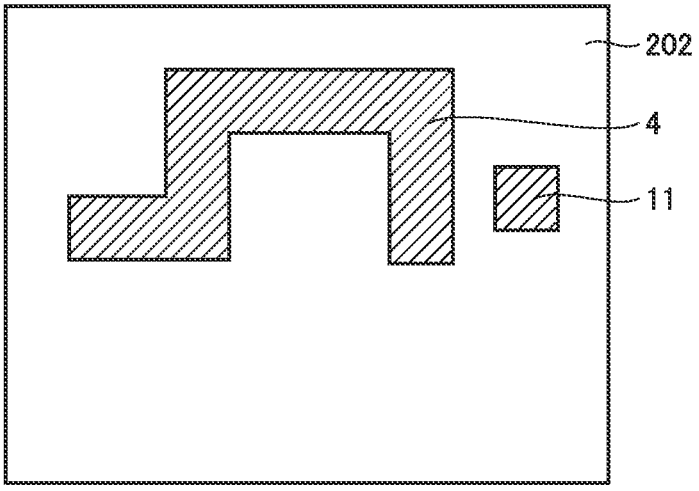
FIG. 7 is a bottom view of a second insulating layer used in the method for manufacturing the stacked coil element according to the second preferred embodiment of the present invention.
Figure 8:
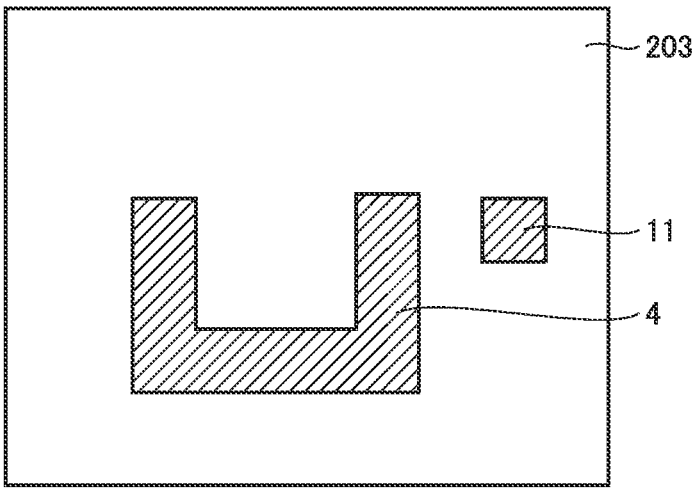
FIG. 8 is a bottom view of a third insulating layer used in the method for manufacturing the stacked coil element according to the second preferred embodiment of the present invention.
Figure 9:
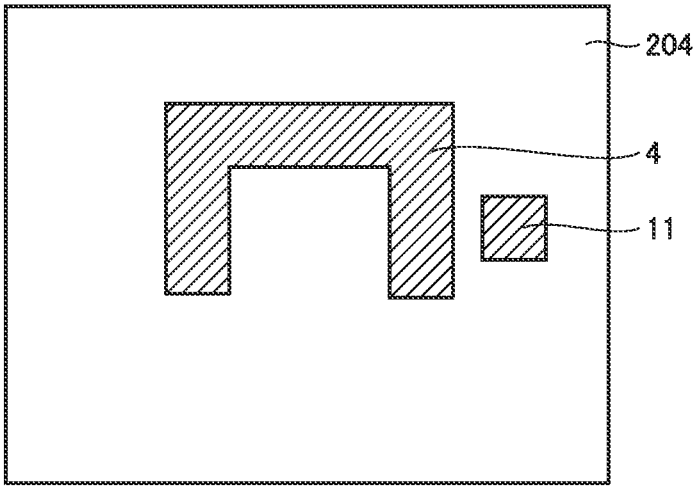
FIG. 9 is a bottom view of a fourth insulating layer used in the method for manufacturing the stacked coil element according to the second preferred embodiment of the present invention.

First, in the step S1, five insulating layers 2 are prepared as shown in FIG. 5, for example. Insulating layer 2 can be formed by being cut into a desired shape from an insulating sheet. Conductor pattern 4 defining a portion of the coil and a conductor pattern 11 for any other purpose are formed as needed on five insulating layers 2. Conductor patterns 4 and 11 can be formed, for example, by patterning a conductive foil by etching and the like in an insulating sheet having the conductive foil affixed to the entire one surface thereof. The conductive foil is, for example, a metal foil. The metal foil herein is, for example, a copper foil. In addition to patterning by etching, conductor patterns 4 and 11 may be formed by screen printing a conductive paste onto a surface of an insulating sheet. Conductive via 6 is also formed in insulating layer 2 so as to penetrate in the thickness direction and electrically connect front and rear surfaces. Conductive via 6 can be formed by boring a through hole in insulating layer 2 using a laser, and thereafter, filling a conductive paste in this through hole.

FIG. 5 shows insulating layers 2 placed in a stacking order. Here, the plurality of insulating layers 2 will be referred to as a first insulating layer 201, a second insulating layer 202, a third insulating layer 203, a fourth insulating layer 204, and a fifth insulating layer 205, in order from the bottom. States of lower surfaces of first insulating layer 201 to fifth insulating layer 205 are shown in FIGS. 6 to 10, respectively. Conductor patterns 4 are formed on the lower surfaces of second insulating layer 202 to fifth insulating layer 205. In the examples shown in FIGS. 5 to 10, second insulating layer 202 to fifth insulating layer 205 correspond to "the plurality of insulating layers" in the step S1. On each of second insulating layer 202 to fourth insulating layer 204, a portion of conductor pattern 4 corresponding to a half of the perimeter of the coil is formed, and these portions will be subsequently stacked alternately and connected electrically to form coil conductor structure 5.

Pad electrodes 8*a* and 8*b* electrically connected to coil conductor structure 5 are formed on the lower surface of first insulating layer 201.

Figure 10:
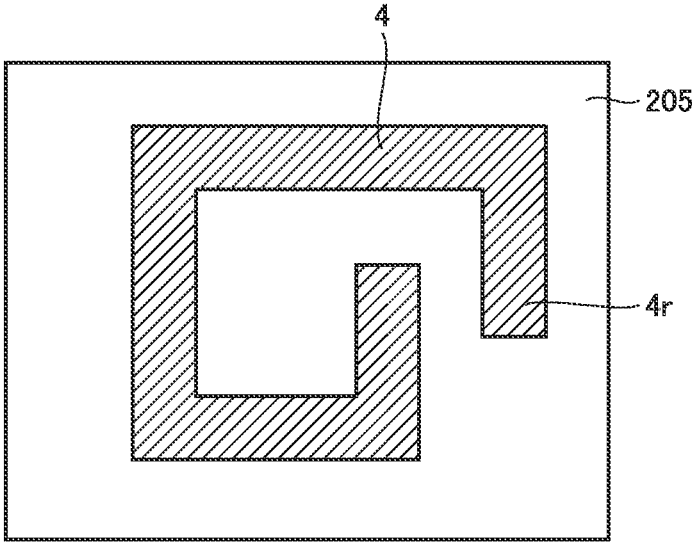
FIG. 10 is a bottom view of a fifth insulating layer used in the method for manufacturing the stacked coil element according to the second preferred embodiment of the present invention.

Furthermore, conductor patterns 11 are also formed on the lower surfaces of second insulating layer 202 to fourth insulating layer 204. Conductor pattern 11 is provided to electrically connect one end in the uppermost layer of coil conductor structure 5 to the lower surface of the stack. In this example, "one end in the uppermost layer of coil conductor structure 5" refers to an end 4*r* of conductor pattern 4 formed on fifth insulating layer 205 as shown in FIG. 10.

Insulating layer 2 of a size corresponding to one stacked coil element is only shown in FIGS. 5 to 10. Actually, however, insulating layer 2 does not yet necessarily need to be separated individually into a size corresponding to one stacked coil element at this point in time. For example, formation of the conductor patterns and the conductive vias may be performed on the large-sized insulator sheet. Therefore, when mention is made of insulating layer 2, insulating layer 2 includes the meaning of not only one piece that has already been separated, but also a portion of the insulator sheet before being separated from the insulator sheet. The insulator sheet is, for example, a resin sheet. The resin sheet is, for example, a thermoplastic resin sheet. As the thermoplastic resin herein, a liquid crystal polymer (LCP) can be used, for example.

Figure 11:
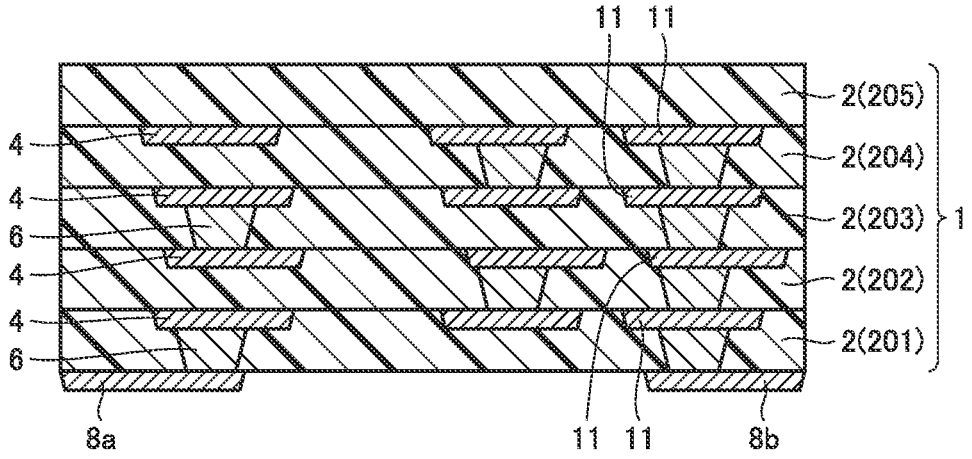
FIG. 11 is an explanatory view of a second step of the method for manufacturing the stacked coil element according to the second preferred embodiment of the present invention.

As the step S2, the stack is obtained by stacking insulating layers 2 having conductor patterns 4 formed thereon. Namely, in the order shown in FIG. 5, first insulating layer 201 to fifth insulating layer 205 are stacked and integrated. When insulating layer 2 is formed by the thermoplastic resin sheet, application of a pressure during heating may be performed in order to achieve integration. By integrating first insulating layer 201 to fifth insulating layer 205, stack 1 is obtained as shown in FIG. 11. Here, stack 1 includes second insulating layer 202 to fifth insulating layer 205 corresponding to "the plurality of insulating layers" in the step S1, and further includes first insulating layer 201 which is insulating layer 2 including no conductor pattern defining a portion of the coil. As described above, insulating layer 2 including no conductor pattern defining a portion of the coil may be included in the group of insulating layers 2 forming stack 1.

Figure 12:
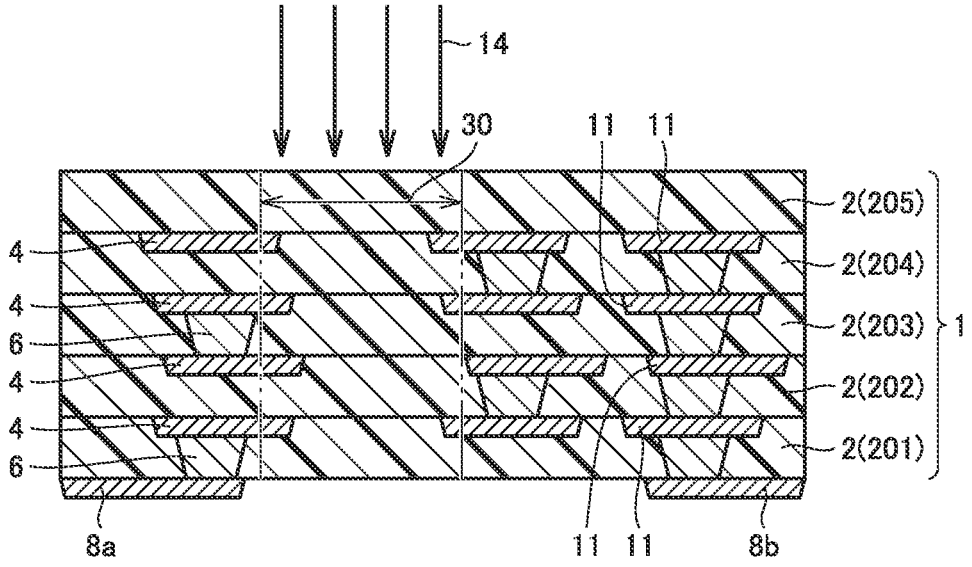
FIG. 12 is an explanatory view of a third step of the method for manufacturing the stacked coil element according to the second preferred embodiment of the present invention.
Figure 13:
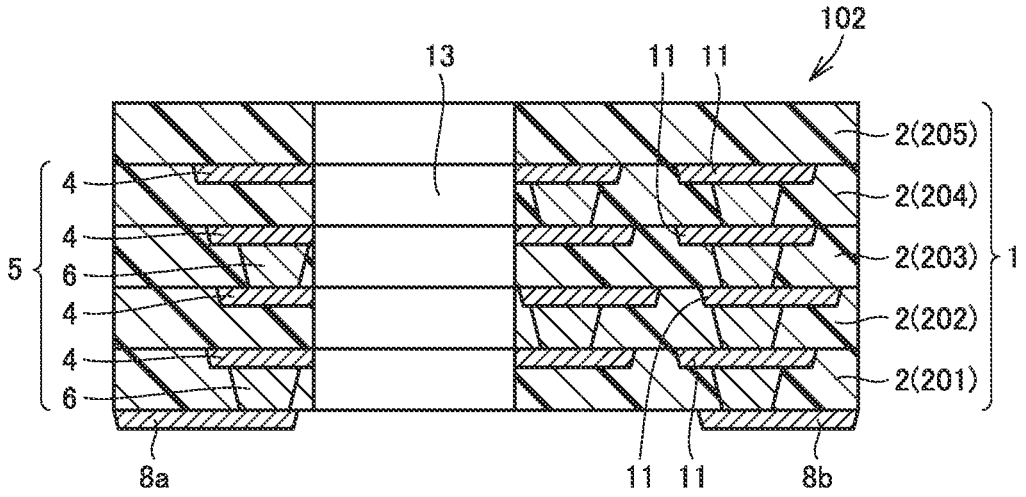
FIG. 13 is a cross-sectional view of a state after the completion of the third step of the method for manufacturing the stacked coil element according to the second preferred embodiment of the present invention.

Next, as the hole boring step S3, laser processing is performed as shown in FIG. 12. Namely, a laser beam 14 is applied to remove a region 30 shown in the figure. A portion of stack 1 is removed in this way, and thus, coil inner hole 13 is formed as shown in FIG. 13. This processing is performed in at least one of the plurality of insulating layers 2 to bore the hole in the portion corresponding to the inner side of coil conductor structure 5, such that a portion of conductor pattern 4 is removed, and the end surface of insulating layer 2 on the hole side and the end surface of conductor pattern 4 on the hole side are in the same plane. In this way, a stacked coil element 102 shown in FIG. 13 is obtained.

In some cases, insulating layers 2 included in stack 1 may be somewhat displaced in the horizontal direction due to an error when insulating layers 2 are stacked. Hereinafter, this displacement will also be referred to as "stacking displacement". Due to the stacking displacement, the positions of conductor patterns 4 are also displaced. Therefore, when coil inner hole is formed by laser processing of region 30, the end corresponding to the inner side of the coil conductor structure may be removed in some conductor patterns, while the end may not at all be removed in a portion of the conductor patterns.

Figure 14:
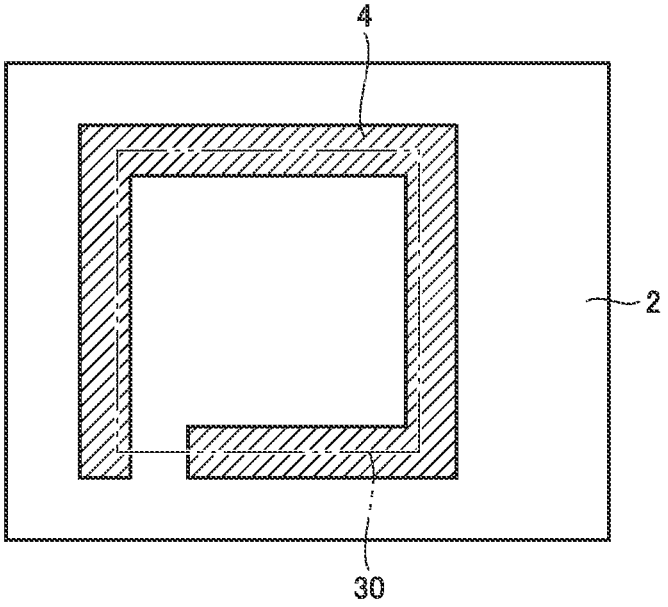
FIG. 14 is an explanatory view of a region to be removed in the method for manufacturing the stacked coil element according to the second preferred embodiment of the present invention.

One example of the range removed by laser processing is as shown in, for example, FIG. 14 when viewed in a plan view. While conductor pattern 4 shown in FIG. 14 is somewhat different in shape from conductor patterns 4 shown in FIGS. 7 to 10, the common idea is applied in the sense of being the conductor pattern defining a portion of the coil. With respect to conductor pattern 4 having a partially interrupted loop shape as shown in FIG. 14, region 30 slightly overlaps with an inner peripheral edge on the inner side of conductor pattern 4. This region 30 is subjected to laser processing. This idea about region 30 to be removed in the hole boring step S3 is applied as well to the case of removal using a method other than laser processing.

According to the present preferred embodiment, in at least one of the plurality of insulating layers 2 having conductor patterns 4 defining a portion of the coil, the hole boring step S3 is performed to bore the hole in the portion corresponding to the inner side of coil conductor structure 5, such that a portion of conductor pattern 4 is removed, and the end surface of insulating layer 2 on the hole side and the end surface of conductor pattern 4 on the hole side are in the same plane. Therefore, in the at least one insulating layer 2, end surface 4*e* of conductor pattern 4 on the coil inner hole 13 side is a surface parallel or substantially parallel to thickness direction 91, i.e., perpendicular or substantially perpendicular to the main surface of stack 1. Namely, at least in this conductor pattern 4, a thin portion is not provided at the end on the coil inner hole 13 side. Therefore, the electrical energy loss caused by concentration of the electric current on the thin portion of the end on the inner peripheral side of the coil during the passage of the electric current is reduced. Here, description is given of the example in which the aforementioned condition is satisfied in at least one of the plurality of insulating layers 2 including conductor patterns 4 defining a portion of the coil. However, the larger number of insulating layers 2 satisfying the aforementioned condition is more preferable.

Figure 15:
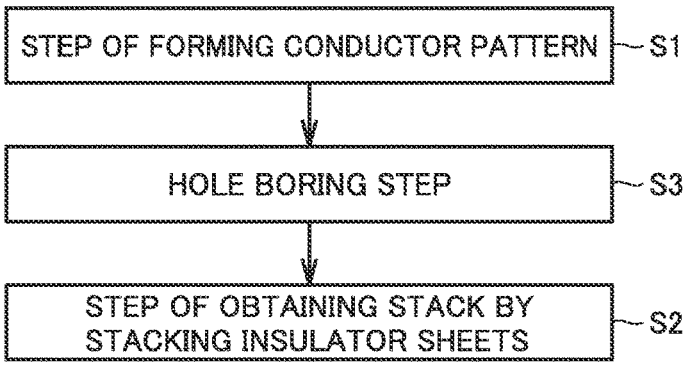
FIG. 15 is a flowchart of a first modification of the method for manufacturing the stacked coil element according to the second preferred embodiment of the present invention.
Figure 16:
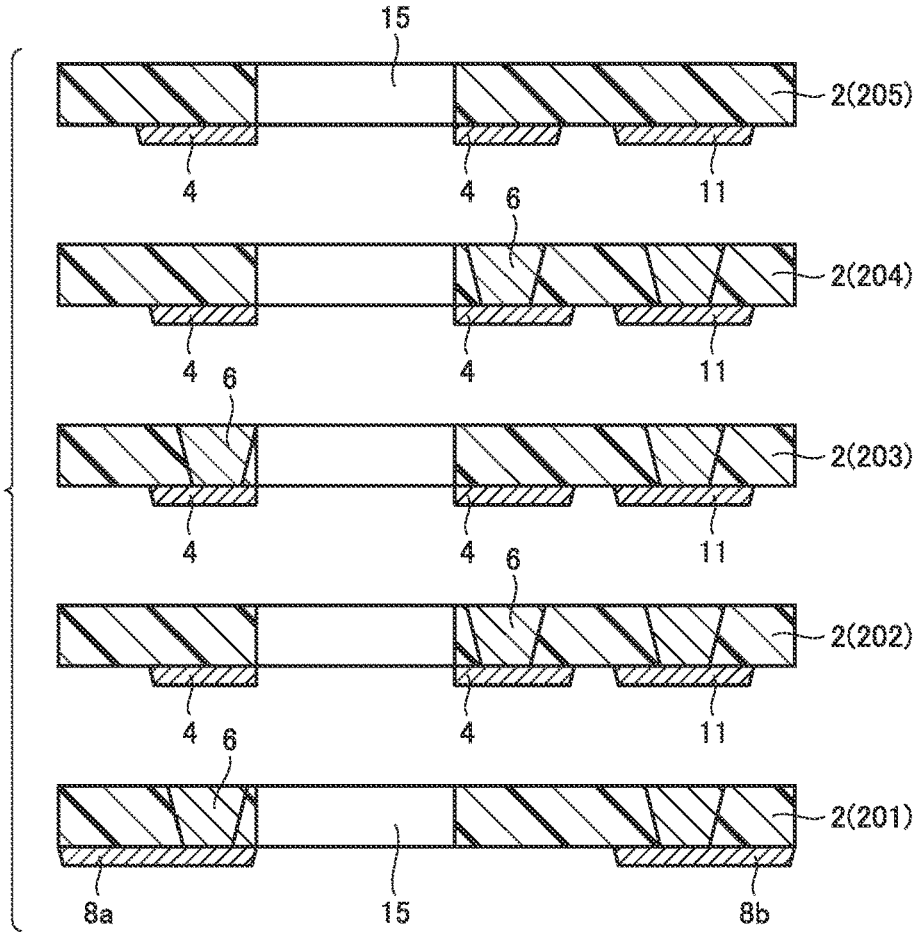
FIG. 16 is an explanatory view of the first modification of the method for manufacturing the stacked coil element according to the second preferred embodiment of the present invention.

According to the present preferred embodiment, description has been given of the example of performing the hole boring step S3 after the step S2 of obtaining the stack in accordance with the flowchart shown in FIG. 4, for example. However, as shown in a flowchart in FIG. 15, the hole boring step S3 may be first performed and then the step S2 of obtaining the stack may be performed. In this case, as shown in FIG. 16, insulating layers 2 are stacked, with through hole 15 having already been bored in each individual insulating layer 2. With this configuration as well, stack 1 can be obtained by integrating stacked insulating layers 2. However, in order to avoid the occurrence of a height difference on the inner surface of coil inner hole 13 due to the stacking error, the steps are preferably performed in the order described in the flowchart shown in FIG. 4. Namely, the hole boring step S3 is preferably performed to stack 1 after the step S2 of obtaining stack 1.

Figure 17:
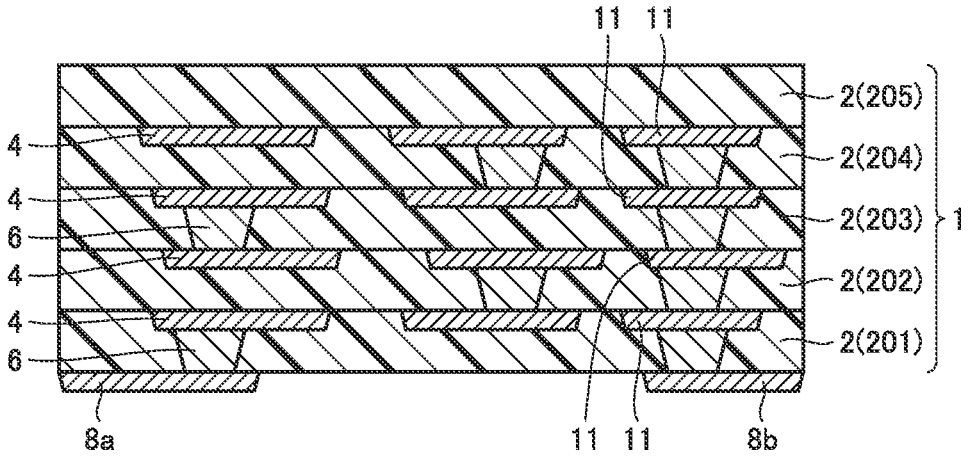
FIG. 17 is an explanatory view of a first step of a second modification of the method for manufacturing the stacked coil element according to the second preferred embodiment of the present invention.
Figure 18:
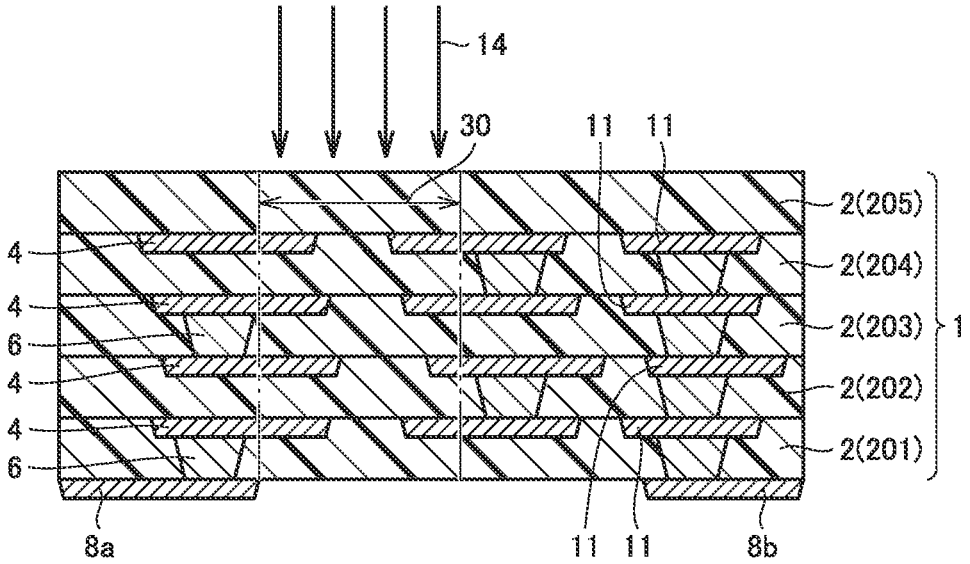
FIG. 18 is an explanatory view of a second step of the second modification of the method for manufacturing the stacked coil element according to the second preferred embodiment of the present invention.
Figure 19:
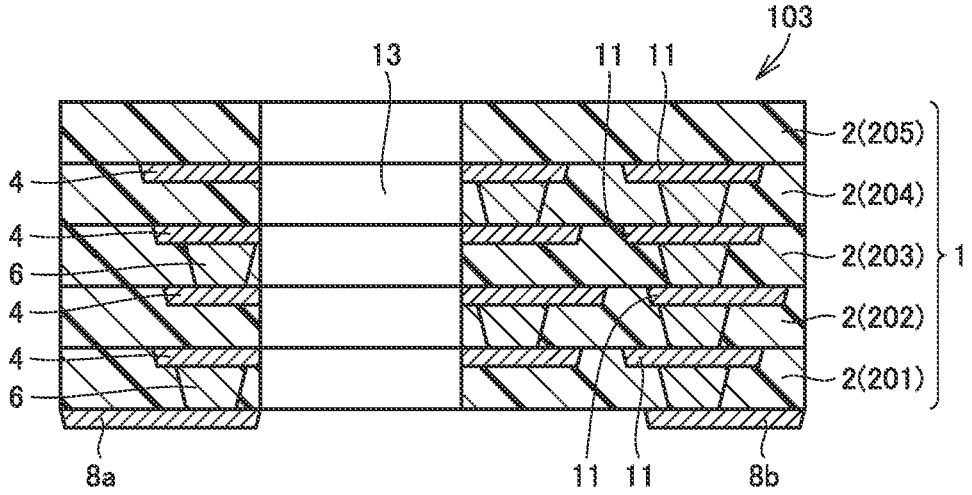
FIG. 19 is a cross-sectional view of a state after the completion of the second step of the second modification of the method for manufacturing the stacked coil element according to the second preferred embodiment of the present invention.

According to the present preferred embodiment, description has been given of the example in which the end corresponding to the inner side of coil conductor structure 5 may not at all be removed in a portion of conductor patterns 4 in the hole boring step S3. Actually, however, the following situation is preferable in view of the problem of stacking displacement. Specifically, it is preferable that in the hole boring step S3, in all of the plurality of insulating layers 2, the hole is bored at a time in the portion corresponding to the inner side of coil conductor structure 5, such that a portion of conductor patterns 4 are removed in all of the plurality of insulating layers 2. In order to achieve this, it is conceivable to form conductor patterns 4 such that conductor patterns 4 extend excessively to some extent toward the inner side of the coil when conductor patterns 4 defining a portion of the coil is formed, as shown in FIG. 17. In this case, a diameter of inner side openings of conductor patterns 4 defining a portion of the coil is small. In this state, the hole boring step S3 may be performed as shown in FIG. 18. By intentionally setting the diameter of the inner side openings small as described above, region 30 irradiated with laser beam 14 has such a positional relation that region 30 reliably overlaps with the inner side ends of all conductor patterns 4 defining a portion of the coil. Namely, by intentionally setting the diameter of the inner side openings of conductor patterns 4 defining a portion of the coil smaller than a diameter of region 30 irradiated with laser beam 14, the inner side ends of all conductor patterns 4 defining a portion of the coil are able to be arranged in region 30 irradiated with laser beam 14. In this way, the portion of stack 1 located in region 30 is removed by laser processing, and thus, coil inner hole 13 is formed as shown in FIG. 19. Thus, a stacked coil element 103 is obtained. As a result, in coil conductor structure 5, in all conductor patterns 4 defining the coil, end surfaces 4*e* of conductor patterns 4 on the coil inner hole 13 side are surfaces parallel or substantially parallel to thickness direction 91, i.e., perpendicular or substantially perpendicular to the main surface of stack 1. Namely, a thin portion is not provided at the ends on the coil inner hole 13 side. Therefore, the electrical energy loss caused by concentration of the electric current on the thin portion of the end on the inner peripheral side of the coil during the passage of the electric current is reduced more reliably. In addition, with this configuration, an inner diameter of the coil is able to be adjusted to a desired size.

Third Preferred Embodiment

Figure 20:
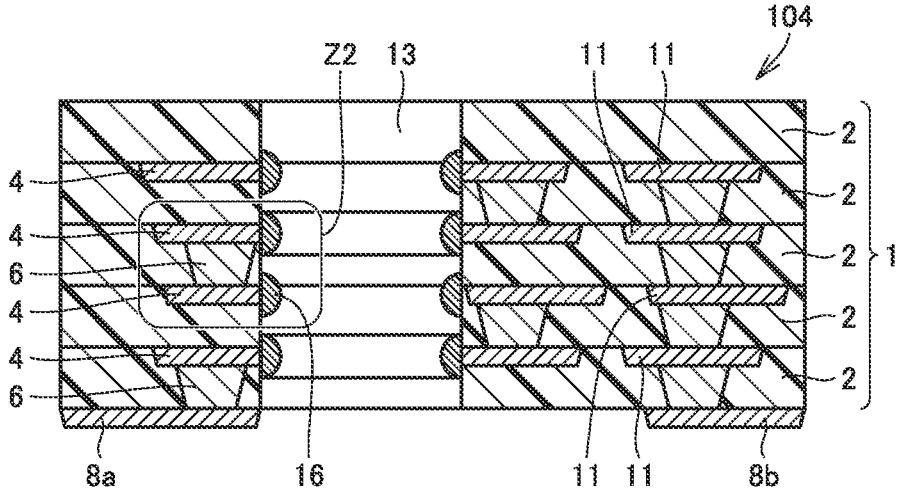
FIG. 20 is a cross-sectional view of a stacked coil element according to a third second preferred embodiment of the present invention.
Figure 21:
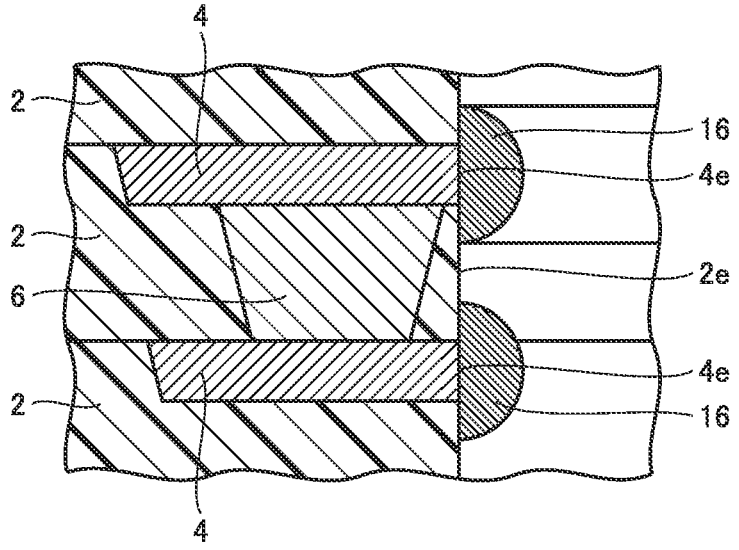
FIG. 21 is an enlarged view of a Z2 portion in FIG. 20.

A stacked coil element 104 according to a third preferred embodiment of the present invention will be described with reference to FIGS. 20 to 21. An enlarged view of a Z2 portion in FIG. 20 is shown in FIG. 21. The basic configuration of stacked coil element 104 according to the present preferred embodiment is similar to that of stacked coil element 101 described in the first preferred embodiment. However, stacked coil element 104 is different from stacked coil element 101 in the following respects.

A plating film 16 is formed to cover end surface 4*e*, on the coil inner hole 13 side, of conductor pattern 4 defining a portion of the coil. When viewed in a cross-sectional view, plating film 16 may only cover a portion of the end surface of conductor pattern 4 on the coil inner hole 13 side. However, plating film 16 is preferably formed to cover the entire end surface of conductor pattern 4 on the coil inner hole 13 side. In addition, when viewed in a plan view, plating film 16 may only cover a portion of the end surface of conductor pattern 4 on the coil inner hole 13 side. However, plating film 16 is preferably formed to cover the entire end surface of conductor pattern 4 on the coil inner hole 13 side.

According to the present preferred embodiment, plating film 16 is formed to cover end surface 4*e*, on the coil inner hole 13 side, of conductor pattern 4 defining a portion of the coil. Therefore, when the electric current flows through coil conductor structure 5, the electric current flows through plating film 16 located on the innermost periphery. When the configuration described according to the present preferred embodiment is adopted, the degree to which the electric current flows through the coil is able to be improved by appropriately selecting a material of plating film 16 and a dimension of plating film 16 in the vertical direction.

The material of plating film 16 may be the same as the material of conductor pattern 4. However, plating film 16 is preferably made of a material having an electrical conductivity higher than that of conductor pattern 4. With this configuration, the electrical energy loss in the coil is able to be further reduced.

The dimension of plating film 16 in the thickness direction of stack 1 is preferably greater than the thickness of conductor pattern 4. In the example shown in FIGS. 20 and 21, this condition is satisfied. With this configuration, even when conductor pattern 4 is thin, a wide electric current path is ensured in an inner peripheral edge of the coil by plating film 16, and thus, the electrical energy loss in the coil is further reduced.

Figure 22:
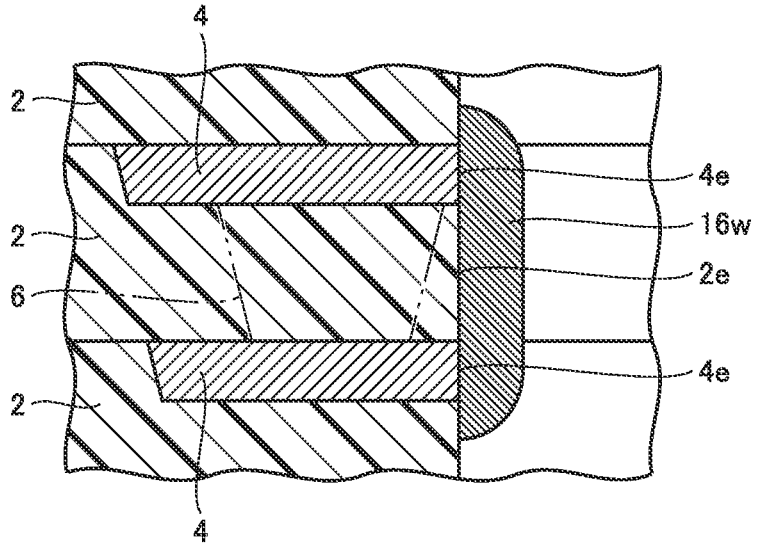
FIG. 22 is an enlarged cross-sectional view of a portion of a modification of the stacked coil element according to the third preferred embodiment of the present invention.

Furthermore, instead of forming plating films 16 so as to correspond to conductor patterns 4 in a one-to-one relation as shown in FIG. 21, it is also conceivable to form an integrated plating film 16*w* so as to extend over two conductor patterns 4 located apart from each other in the vertical direction as shown in FIG. 22. With this configuration, plating film 16*w* is able to define and function as conductive via 6, and thus, conductive via 6 can be omitted as shown in FIG. 22. In this case, however, plating film 16*w* preferably does not cover the entire inner periphery of the coil when viewed in a plan view, but is provided exclusively on a portion of the inner periphery of the coil where interlayer connection is to be made. FIG. 22 is a cross-sectional view taken along a cutting line passing through the portion of the inner periphery of the coil where plating film 16*w* is located.

On the basis of the manufacturing method described in the second preferred embodiment, a manufacturing method for obtaining stacked coil element 104 according to the present preferred embodiment may be further configured as follows.

Specifically, the step of plating the end surface of conductor pattern 4 on the hole side may be included after the hole boring step S3 in the manufacturing method described in the second preferred embodiment.

Fourth Preferred Embodiment

Figure 23:
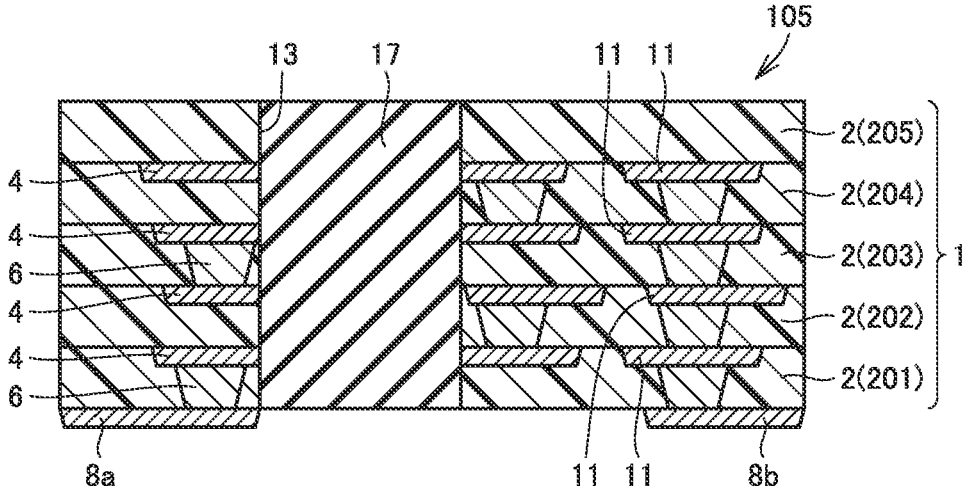
FIG. 23 is a cross-sectional view of a stacked coil element according to a fourth preferred embodiment of the present invention.

A stacked coil element 105 according to a fourth preferred embodiment of the present invention will be described with reference to FIG. 23. The basic configuration of stacked coil element 105 according to the present preferred embodiment is similar to that of stacked coil element 101 described in the first preferred embodiment. However, stacked coil element 105 is different from stacked coil element 101 in the following respects.

An insulating material 17 is filled in coil inner hole 13.

According to the present preferred embodiment, insulating material 17 is filled in coil inner hole 13, and thus, the strength of stack 1 is increased. In addition, entry of the water and the like from the inner surface of coil inner hole 13 is prevented. Insulating material 17 may be a so-called underfill. Insulating material 17 may be, for example, an epoxy resin.

Insulating material 17 is preferably a material having a low dielectric constant, and particularly preferably a low dielectric constant material having a relative dielectric constant of not higher than 5. As the low dielectric constant material herein, a liquid crystal polymer and the like can, for example, be used. By adopting these configurations, the self-resonant frequency of the coil is able to be increased.

Alternatively, insulating material 17 is preferably a magnetic material. By adopting this configuration, an inductance value of the coil is able to be increased. The magnetic material herein may be, for example, a mixture of ferrite and resin.

On the basis of the manufacturing method described in the second preferred embodiment, a manufacturing method for obtaining stacked coil element 105 according to the present preferred embodiment may be further configured as follows.

Specifically, the step of filling insulating material 17 in an internal space of the hole may be included after the hole boring step S3 in the manufacturing method described in the second preferred embodiment.

Furthermore, in the filling step, insulating material is preferably a material having a low dielectric constant, and particularly preferably a low dielectric constant material having a relative dielectric constant of not higher than 5, as described above. With this configuration, the structure having the low dielectric constant material arranged on the inner side of the coil is obtained, and the self-resonant frequency of the coil is increased.

Alternatively, in the filling step, insulating material 17 may be a magnetic material. With this configuration, the structure having the magnetic material arranged on the inner side of the coil is obtained, and the inductance value of the coil is increased.

Modification

A modification of the stacked coil element according to the present preferred embodiment will be described with reference to FIGS. 24 and 25. In the present modification, the step of filling insulating material 17 in the internal space of the hole is performed as follows. In the present modification, however, the hole boring step S3 is performed to a stack of second insulating layer 202 to fourth insulating layer 204, and no hole is bored in first insulating layer 201 and fifth insulating layer 205.

Figure 24:
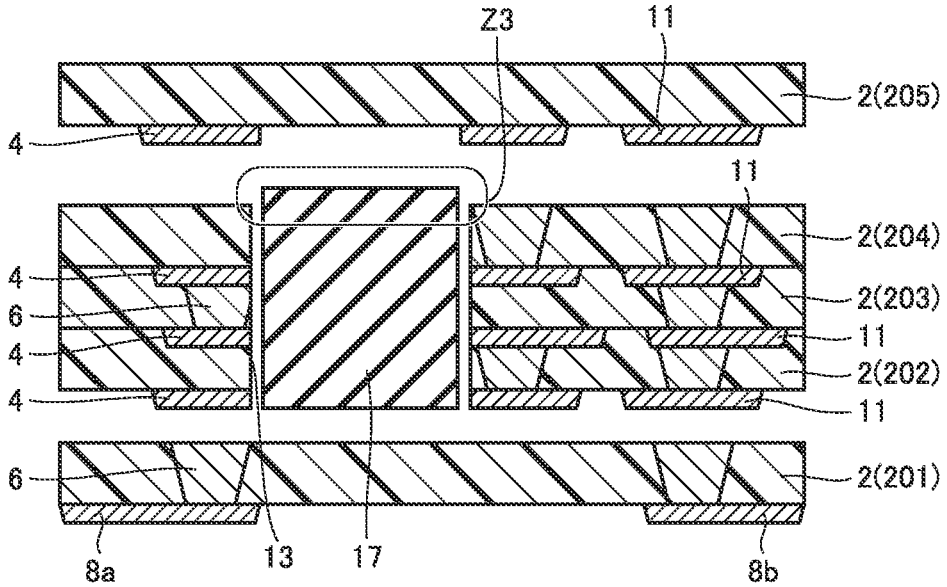
FIG. 24 is an explanatory view of an intermediate stage in manufacturing a modification of the stacked coil element according to the fourth preferred embodiment of the present invention.

As shown in FIG. 24, solid-state insulating material 17 is inserted into coil inner hole 13 defined by the stack of second insulating layer 202 to fourth insulating layer 204. At this point in time, there may be a gap between coil inner hole and insulating material 17. Because of the certain gap, insertion of insulating material 17 becomes easy. At this point in time, second insulating layer 202 to fourth insulating layer 204 may have already been integrated preliminarily, or may be a mere stack of separate insulating layers. However, second insulating layer 202 to fourth insulating layer 204 integrated preliminarily are preferable because positional displacement of the insulating layers is less likely to occur.

As shown in FIG. 24, first insulating layer 201 is arranged on the lower side of second insulating layer 202 and fifth insulating layer 205 is arranged on the upper side of fourth insulating layer 204. Then, pressing and heating are performed in the vertical direction. In this way, a structure shown in FIG. 25 is obtained. Namely, a stacked coil element 106 is obtained.

With this configuration, when pressing and heating are performed in the vertical direction, the resin forming first insulating layer 201 and fifth insulating layer 205 is likely to flow from first insulating layer 201 and fifth insulating layer 205 arranged on the upper and lower sides of insulating material into the gap present between coil inner hole 13 and insulating material 17. Therefore, even if the gap is present, the gap can be filled after pressing and heating.

Furthermore, with this configuration, both main surfaces (upper and lower surfaces) of the stacked coil element are flattened more easily during pressing and heating, as compared with the case in which first insulating layer 201 and fifth insulating layer 205 are not present. Namely, even in the case of using, as insulating material 17, a material such as, for example, epoxy resin that is less likely to flow during pressing and heating, irregularities on the pressed surfaces are absorbed and the flatness of the stacked coil element is easily maintained because first insulating layer 201 and fifth insulating layer 205 made of a resin that is likely to flow during pressing and heating are present on the outermost surfaces.

Only one of first insulating layer 201 and fifth insulating layer 205 may be provided.

First insulating layer 201 to fourth insulating layer 204 may be integrated and a recessed portion having a bottom may be formed preliminarily, and then, insulating material 17 may be arranged in this recessed portion. In this case, insulating material 17 is provided, and thereafter, fifth insulating layer 205 is placed to cover the upper surfaces of both fourth insulating layer 204 and insulating material 17, and pressing and heating are performed in the vertical direction. In this way, a stacked coil element 106 is able to be similarly obtained.

As shown in FIG. 24, a dimension of insulating material 17 in the vertical direction is preferably slightly greater than a total of thicknesses of second insulating layer 202 to fourth insulating layer 204 before pressing and heating. By setting the dimension of insulating material 17 in the vertical direction slightly greater as described above, the upper surface of insulating material 17 protrudes from the upper surface of fourth insulating layer 204 as shown by a Z3 portion in FIG. 24. By setting the dimension of insulating material 17 in the vertical direction slightly greater as described above, pressing is able to be performed reliably. The dimension of insulating material 17 in the vertical direction may be the same as or slightly smaller than the total of the thicknesses of second insulating layer 202 to fourth insulating layer 204 before pressing and heating.

Figure 25:
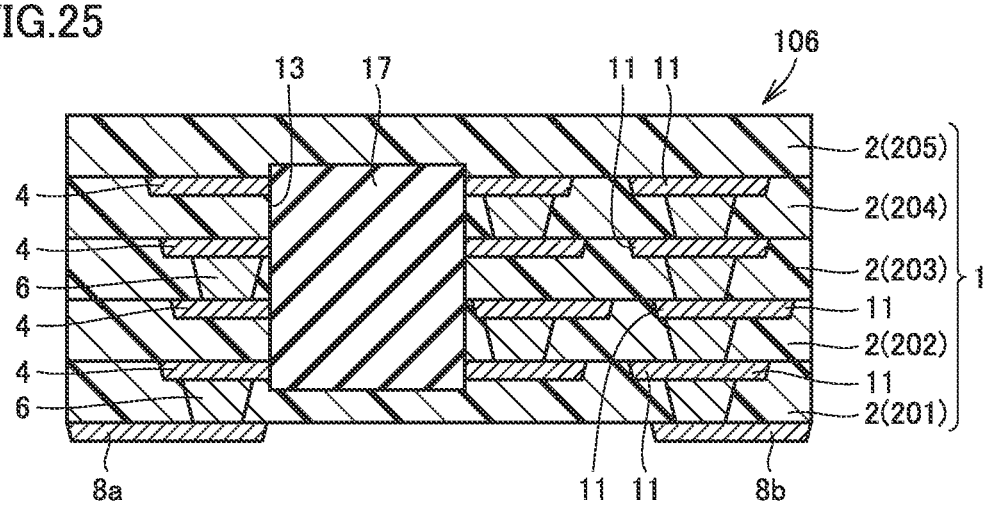
FIG. 25 is a cross-sectional view of the modification of the stacked coil element according to the fourth preferred embodiment of the present invention.

In the example shown in FIGS. 24 and 25, one insulating layer having no hole is arranged on the upper side and one insulating layer having no hole is arranged on the lower side. However, not only one insulating layer but also two or more insulating layers may be arranged either on the upper or lower side, or both on the upper and lower sides.

Fifth Preferred Embodiment

A method for manufacturing a stacked coil element according to a fifth preferred embodiment of the present invention will be described with reference to FIGS. 26 to 27. On the basis of the manufacturing method described in the second preferred embodiment, the method for manufacturing the stacked coil element according to the present preferred embodiment may be further configured as follows.

Figure 26:
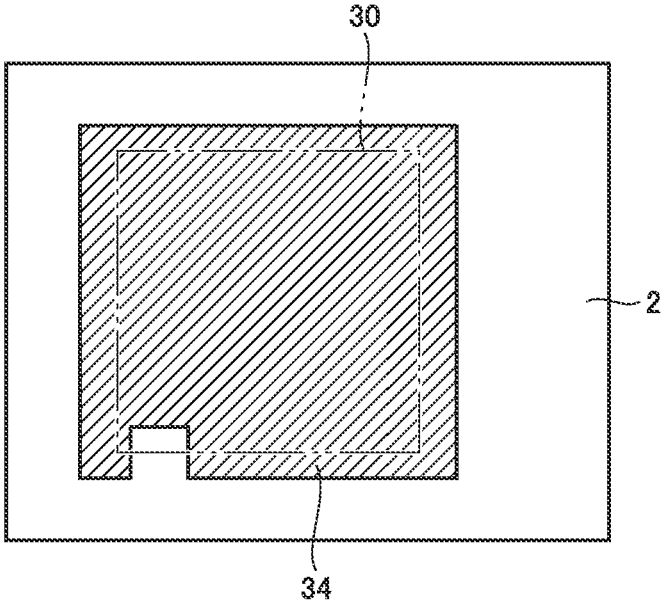
FIG. 26 is a first explanatory view of a method for manufacturing a stacked coil element according to a fifth preferred embodiment of the present invention.
Figure 27:
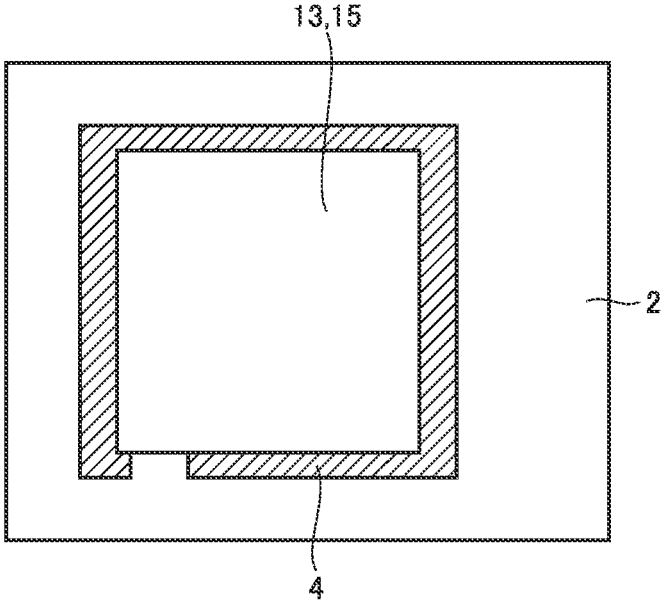
FIG. 27 is a second explanatory view of the method for manufacturing the stacked coil element according to the fifth preferred embodiment of the present invention.

In the step S1, instead of conductor pattern 4, a conductor pattern 34 is formed as shown in FIG. 26. Conductor pattern 34 does not have a substantially loop shape but has a so-called solid shape in which the inside is almost filled. When this conductor pattern 34 is used, substantially loop-shaped conductor pattern 4 shown in FIG. 27 can be obtained by removing region 30 in the hole boring step S3. This idea is also applicable to the case of performing the hole boring step S3 after the step S2 of obtaining the stack, and is also applicable to the case of performing the step S2 of obtaining the stack after the hole boring step S3. In the case of performing the hole boring step S3 after the step S2 of obtaining the stack, a portion of conductor pattern 34 located in region 30 is also removed together when coil inner hole 13 is bored. In the case of performing the step S2 of obtaining the stack after the hole boring step S3, through hole 15 is bored by removing the portion of conductor pattern 34 located in region 30 in individual insulating layer 2.

In the foregoing description, the hole boring step S3 preferably is performed by laser processing. However, this is merely one example. The hole boring step S3 may be performed by using a known processing method other than laser processing. For example, punching may be performed. However, in the case of punching, care should be taken to prevent deformation of an inner peripheral edge of the conductor pattern as much as possible during punching.

Figure 28:
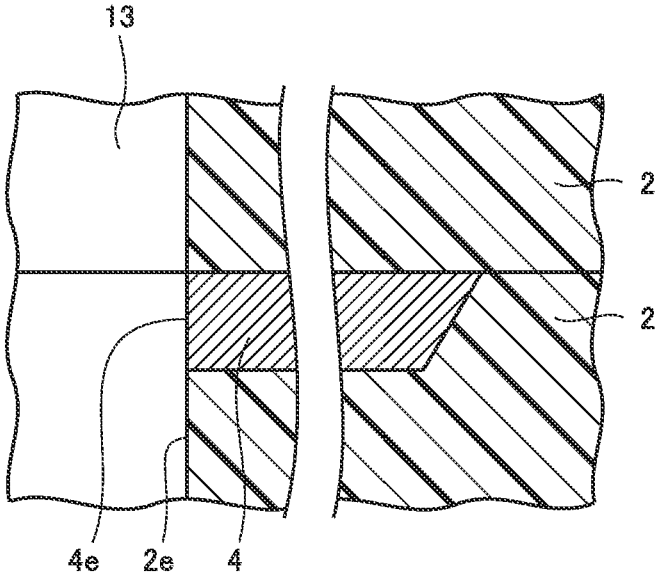
FIG. 28 is a first explanatory view of a magnitude relationship of a thickness of an end of a conductor pattern.
Figure 29:
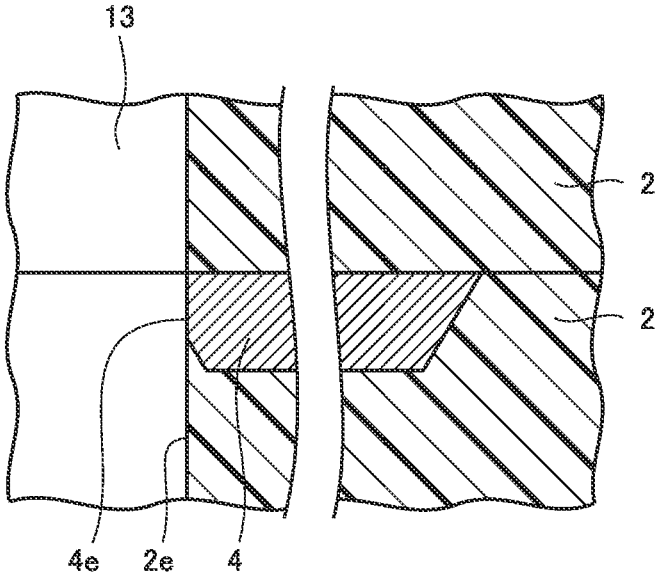
FIG. 29 is a second explanatory view of a magnitude relationship of the thickness of the end of the conductor pattern.

The preferred embodiments described above can also be expressed as follows, with attention focused on the magnitude relationship of the thickness of the end of conductor pattern 4. The end of conductor pattern 4 on the coil inner hole 13 side preferably has a thickness greater in the thickness direction of stack 1 than that of the end of conductor pattern 4 on the opposite side of the coil inner hole 13 side. This also includes a configuration in which the end of conductor pattern 4 on the coil inner hole 13 side is not locally reduced in thickness and has vertically upright end surface 4*e*, while the end on the opposite side is gradually reduced in thickness toward the tip, as shown in FIG. 28. In addition, this also includes a configuration in which the end of conductor pattern 4 on the coil inner hole 13 side is gradually reduced in thickness toward the edge and has vertically upright end surface 4*e* at some midpoint, while the end on the opposite side is gradually reduced in thickness toward the tip, as shown in FIG. 29, for example. The configurations shown in FIGS. 28 and 29 are merely typical examples and the present invention is not limited thereto. It is preferable if, comparing the end of conductor pattern 4 on the coil inner hole 13 side and the end on the opposite side, the former can be regarded as being greater in thickness.

The preferred embodiments disclosed herein are illustrative and not limitative in any respect. The scope of the present invention is defined by the terms of the claims, rather than the description above, and is intended to include any modifications within the scope and meaning equivalent to the terms of the claims.

Preferred embodiments of the present invention are able to be used in a stacked coil element and a method for manufacturing the same.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A stacked coil element comprising:

a stack including a plurality of insulating layers and a coil conductor structure with a winding axis in a thickness direction, and conductor patterns defining a portion of a coil provided on the insulating layers and electrically connected in the thickness direction; wherein the stack includes a coil inner hole on an inner peripheral side of the coil conductor structure, the coil inner hole penetrating in the direction of the winding axis or having the direction of the winding axis as a depth direction;

the coil inner hole penetrates through two or more of the plurality of insulating layers that are adjacent to each other in the thickness direction; and in the two or more of the plurality of insulating layers adjacent to each other in the thickness direction, on a coil inner hole side, all of end surfaces of the conductor patterns on the two or more of the plurality of insulating layers and end surfaces of the two or more insulating layers are in a same plane perpendicular or substantially perpendicular to a main surface of the stack.

2. The stacked coil element according to claim 1, wherein in all of the plurality of insulating layers, on the coil inner hole side, all of the end surfaces of the conductor patterns and the end surfaces of the insulating layers are in the same plane.

3. The stacked coil element according to claim 1, wherein an insulating material is filled in the coil inner hole.

4. The stacked coil element according to claim 3, wherein the insulating material is a magnetic material.

5. The stacked coil element according to claim 1, wherein an end of the conductor pattern on the coil inner hole side has a thickness greater in the thickness direction of the stack than a thickness of an end of the conductor pattern on an opposite side of the coil inner hole side.

6. A stacked coil element comprising a stack including a plurality of insulating layers and a coil conductor structure with a winding axis in a thickness direction, and conductor patterns defining a portion of a coil provided on the insulating layers and electrically connected in the thickness direction; wherein the stack includes a coil inner hole on an inner peripheral side of the coil conductor structure, the coil inner hole penetrating in the direction of the winding axis or having the direction of the winding axis as a depth direction;

the coil inner hole penetrates through two or more of the plurality of insulating layers that are adjacent to each other in the thickness direction;

in at least one of the two or more of the plurality of insulating layers, on a coil inner hole side an end surface of a respective one of the conductor patterns is in a same plane as an end surface of the insulating layer; and a plating film covers the end surface of the conductor pattern on the coil inner hole side.

7. The stacked coil element according to claim 6, wherein a dimension of the plating film in the thickness direction of the stack is greater than a thickness of the conductor pattern.

8. The stacked coil element according to claim 6, wherein in the two or more of the plurality of insulating layers adjacent to each other in the thickness direction, on the coil inner hole side, all of the end surfaces of the conductor patterns on the two or more of the plurality of insulating layers and the end surfaces of the two or more insulating layers are in the same plane.

9. The stacked coil element according to claim 6, wherein in all of the plurality of insulating layers, on the coil inner hole side, all of the end surfaces of the conductor patterns and the end surfaces of the insulating layers are in the same plane.

10. The stacked coil element according to claim 6, wherein an insulating material is filled in the coil inner hole.

11. The stacked coil element according to claim 10, wherein the insulating material is a magnetic material.

12. The stacked coil element according to claim 6, wherein an end of the conductor pattern on the coil inner hole side has a thickness greater in the thickness direction of the stack than a thickness of an end of the conductor pattern on an opposite side of the coil inner hole side.

* * * * *